US006928335B1

(12) United States Patent
Zweigle

(10) Patent No.: US 6,928,335 B1
(45) Date of Patent: Aug. 9, 2005

(54) DEVICE FOR OPTIMIZING FABRICS BASED ON MEASURED THREAD DATA AND OPTIMIZATION METHOD

(76) Inventor: Dieter Zweigle, Ferdinand-Lassalle-Strasse 54., D-72770 Reutlingen (DE)

( * ) Notice: Subject to any disclaimer, the term of this patent is extended or adjusted under 35 U.S.C. 154(b) by 0 days.

(21) Appl. No.: 09/423,179

(22) PCT Filed: Apr. 29, 1998

(86) PCT No.: PCT/EP98/02529

§ 371 (c)(1),
(2), (4) Date: Nov. 2, 1999

(87) PCT Pub. No.: WO98/50613

PCT Pub. Date: Nov. 12, 1998

(30) Foreign Application Priority Data

May 2, 1997 (DE) ..... 197 18 562

(51) Int. Cl.[7] ..... G06F 19/00; D03C 19/00

(52) U.S. Cl. ..... 700/131; 700/143; 356/238.2; 356/430

(58) Field of Search ..... 700/97, 98, 122, 700/130, 131, 133, 139, 142–144; 356/238.1, 356/238.2, 430, 429; 382/111; 348/88; 257/216; 250/559.24, 559.46; 139/319

(56) References Cited

U.S. PATENT DOCUMENTS 4,803,531 A * 2/1989 Riley et al. ..... 257/216
4,887,155 A * 12/1989 Massen ..... 348/88
5,016,183 A * 5/1991 Shyong ..... 700/131
5,671,061 A * 9/1997 Hoeller ..... 356/429
6,130,746 A * 10/2000 Nevel et al. ..... 356/238.2

* cited by examiner

*Primary Examiner*—Leo Picard
*Assistant Examiner*—Steven R. Garland

(57) ABSTRACT

An apparatus for optimizing actual woven fabrics on the basis of measured yarn data has at least one measuring device for measuring the yarn diameter, a structure input device for inputting and freely changing definable structures, a device for controlling the measuring device and for evaluation, and a display device. The actual fabric being computed and represented on the basis of the measured yarn diameters and the freely definable structure and the fact that the defined structure of the fabric can be changed making it possible to adapt and optimize the actual fabric to the measured individual yarn diameters.

15 Claims, 1 Drawing Sheet

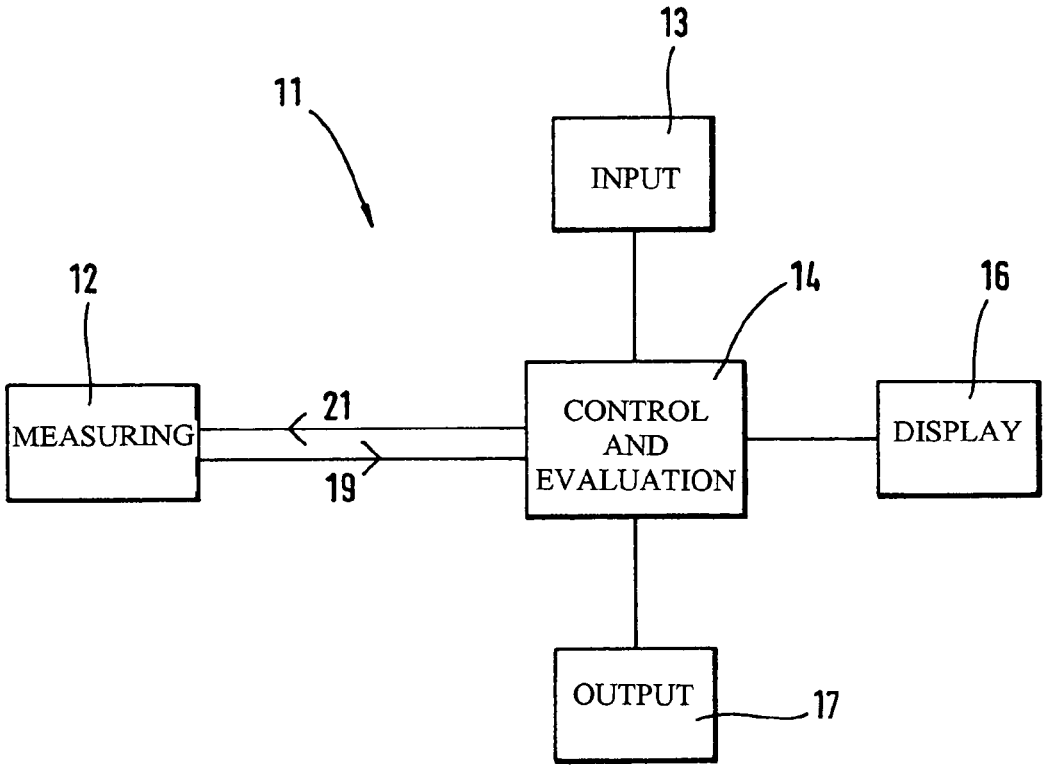
13
11
INPUT
12
14
16
MEASURING
21
CONTROL
AND
EVALUATION
DISPLAY
19
OUTPUT
17

DEVICE FOR OPTIMIZING FABRICS BASED ON MEASURED THREAD DATA AND OPTIMIZATION METHOD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an apparatus for optimizing yarns and woven fabrics on the basis of measured yarn data and to the associated method of optimization.

TECHNICAL FIELD

The development of new woven fabrics is usually carried out with CAD systems. These known CAD systems allow new fabrics to be developed by changing a large number of parameters. However, in CAD systems the computation is always based on "ideal" yarns, i.e. yarns of which the diameter, fineness and tear strength is constant over the entire yarn.

In the case of actual yarns, however, the yarn diameters and other yarn properties are not constant over the length of the yarn, as they are in the case of "ideal yarn". For instance, actual yarns have nips, slubs, neps etc., which of course have an effect on the appearance of the later "actual fabric", but are not taken into account in the development of the fabric on the CAD system. This has the effect that the actual fabric obtained often does not meet the expectations of the designer.

The object of the invention is to improve the systems for developing new fabrics and/or to optimize machine settings or processes in yarn manufacture.

This object is achieved by providing an apparatus which makes it possible to take into account during the design of the fabric the actual values of the respective yarn and which at the same time makes it possible to adapt and/or change the structure or any desired crossover point, taking into account the visual appearance of each yarn.

With the apparatus according to the invention, it is possible by changes to each and every crossover visually to emphasize or suppress nips, slubs or neps. In some fabrics, it is precisely the visual effects achieved by irregular yarns that are desired and, by being able to define the structure freely, it is possible in the case of desired irregularities to bring them out visually by the type of respective structure.

SUMMARY OF THE INVENTION

In the apparatus according to the invention, the yarn diameter of the respective individual yarn is measured optoelectronically on the basis of the defined type of desired structure, a three-dimensional representation of the actual yarn is computed, taking into account the individual measured values of the yarns, and is visually displayed. Each and every crossover can be changed preferably using a schematized representation of the fabric on a screen and input with the keyboard or a mouse. The actual fabric can in turn be visually displayed and changed as much as required until the desired design is obtained.

The three-dimensional representation of the actual fabric also means that considerable amounts of yarn, machines, power and working time are saved, since it is no longer necessary to switch on the loom to see how the actual fabric looks, perhaps then to declare it a reject. Tie combination of the structure input device and free selectability of the weaving density also contributes to reducing the number of rejects.

Furthermore, in a particular embodiment it is possible in the apparatus according to the invention also to measure the colours along a yarn and to transfer them into the evaluation device, so that in addition to the actual yarn diameters the actual colours can also be taken into account in the computation of the actual fabric.

BRIEF DESCRIPTION OF THE DRAWINGS

The invention is now explained in more detail with reference to an exemplary embodiment:

FIG. 1 shows the construction of the apparatus according to the invention for optimizing actual fabrics on the basis of measured yarn data.

DETAILED DESCRIPTION OF THE INVENTION

The apparatus 11 comprises a measuring device 12, which serves for measuring the yarn diameter, a structure input device 13, in which the respective desired structure can be freely defined and also changed, a control and evaluation device 14 and a display device 16, in particular a screen.

The measuring of the yarn diameter in the measuring device 12 takes place in the measuring head, which operates on the optical principle of absolute measurement. The advantage of absolute optoelectronic measurement is that the measurement is insensitive to light source aging, extraneous light, soiling, temperature and humidity and is not dependent on the colour, conductivity and lustre of the yarn to be measured. Such measurement also does not require constant recalibration and input of parameters.

For the measuring of natural yarns, it is generally adequate to use a measuring head with the accuracy of 0.1 mm. However, depending on the type of yarn to be measured, for example in the case of yarns of man-made fibres or else in individual cases of yarns of natural fibres, measuring heads with the accuracy of at least 0.01 mm are used with preference.

In addition to the measuring head, the measuring device 12 comprises a yarn feed and electronics.

Such measuring heads are known from the prior art and are sold, for example, by BARCO/Belgium.

For the optimizing apparatus according to the invention it is necessary that the accuracy of the yarn diameter measurement is at least 1/100 mm. The measuring of the diameter of the yarn should take place at least every 2 mm.

The measured values determined in the measuring device 12 are then transferred into the evaluation device 14 via a parallel interface 19. The evaluation device 14 at the same time controls the measuring device 12 by a serial interface 21.

Also connected to the device 14 is the device 13 for inputting and changing freely definable structures. In the structure input device 13, any possible type of crossover of the groups of threads can be defined. Preferably, these are flat fabric structures. By accessing already defined structures, this device makes it possible to define individually any desired structure and to change already existing structures at any number of crossovers. The input and changing of the respective structure most easily takes place using a PC, by marking the respective crossover points displayed on a screen, for example with a mouse or using the keyboard.

The structure input device 13 is preferably integrated together with the control and evaluation device 14 in a computer.

Once the measuring of the respective yarn has taken place in the device 12 and a structure has been defined in the device 13, the computation of the three-dimensional representation of the actual fabric takes place in the device 14 on the basis of the freely defined structure and the yarn diameters measured. The representation takes place on a screen 16 connected to the evaluation device 14. Optionally, an output device 17 may be connected to the evaluation device 14.

The measured data are visually displayed along space curves, variation in brightness (shadow effect) and colour being taken into account and a coverage calculation of the threads being carried out. In the visual display, light settings, camera position and focal length can be changed.

The representation on the screen preferably takes place by parallel projection of the object by means of a 3D graphics library. However, other projections are also possible.

Of course, for the computation of the actual fabric, the parameters of the loom (fabric size) must also be input and assigned to warp and weft threads, in order that the computed actual fabric really corresponds to the result woven later.

On the basis of this three-dimensional representation of the actual fabric, individual structures can then be changed in order to produce an individual fabric in which specific nips, slubs and/or neps due to the individual type of crossover of the threads in the fabric structure are emphasized more or suppressed. For documentation purposes, the three-dimensional representation of the optimized actual fabric can then be output on a printer or copier 17, preferably in colour.

If desired, the measured values can also be statistically evaluated. The statistical evaluation makes it possible to make statements about the quality of the yarns.

The statistical functions should comprise not only a statistical evaluation of an individual measured yarn which is possible at any time but also statistical evaluation taken over entire totals of series of measurements of individual yarns and/or freely definable and selectable individual measurements of yarns and should make it possible to obtain mean values, standard deviations, variances and other statistical evaluations of the measured individual yarns and/or groups of yarns. A two-dimensional and/or three-dimensional graphic representation of the respectively desired statistical functions is also envisaged.

In a preferred embodiment of the apparatus according to the invention, the computation and/or visual display of the fabric partially and/or completely with ideal yarns is also envisaged.

The graphic representation of the three-dimensional actual fabric may also take place in certain selectable colours, it being possible for each yarn to be assigned a colour.

The colour selection preferably takes place for each desired actual and/or ideal yarn by input of the respectively desired red-green-blue values, so that freely definable and selectable colours are available.

Of course, it is possible to store measured parameters, measured yarn diameters, statistical evaluations, computed actual fabrics, freely defined structures, parameters of the loom etc. in a data bank and call them up again as and when needed.

It is of course possible in the case of the apparatus according to the invention to import and export outside files.

The apparatus according to the invention also makes it possible—for example for the identification of periodic errors, such as the moiree effect—to display on the screen and also print out the measured yarn in the form of the standard yarn chart in the standardized dimensions.

If the resolution of the screen 16 and/or of the output device 17 is not adequate, a segmentation of the standard yarn chart into, for example, three segments is envisaged, which even in the case of a resolution limited by the hardware allows the standard yarn chart to be represented in segments at the required high resolution for identification of the periodic errors.

It is optionally likewise possible on the basis of the measured yarn data to have an actual weft-knitted fabric simulated, for example single-jersey, plain, plain rib, interlock, pique etc. or else a warp-knitted fabric.

Of course, the knitted fabrics can also be input and changed in the structure input device (13).

What is claimed is:

1. An apparatus that optimizes the development of woven fabrics, comprising:

a display device that displays the woven fabrics that are developed in the apparatus, a structure input device that inputs freely definable fabric structures for woven fabrics, at least one measuring device for measuring individual yarn diameters, and a control and evaluation device that controls the woven fabrics and that also controls the at least one measuring device using a serial interface and the same time the control and evaluation device receives data on a parallel interface between the measuring device and the control and evaluation device, wherein the structure input device enables inputting and changing the woven fabrics, and wherein an actual fabric is computed and presented on the basis of the individual yarn diameters and the freely definable structures for woven fabrics, whereby a defined structure of the fabric is changeable to adapt and optimize the actual fabric to the measured individual yarn diameters.

2. The apparatus according to claim 1, wherein the at least one measuring device comprises an optoelectronic device.

3. The apparatus according to claim 2, wherein the optoelectronic device comprises a measuring device that carries out absolute measurements and operates in an infrared range.

4. The apparatus according to claim 1, wherein the measuring device has an accuracy of at least 1/100 mm.

5. The apparatus according to claim 1, wherein the defined structure of the actual fabric is graphically represented.

6. The apparatus according to claim 5, wherein the computed actual fabric is represented on a screen.

7. The apparatus according to claim 6, wherein a representation of the computed actual fabric comprises parallel projection of an object by via a three dimensional graphics library.

8. The apparatus according to claim 1, wherein each structure is defined by a two dimensional matrix.

9. The apparatus according to claim 1, comprising an output device comprising a color printer or a color copier.

10. The apparatus according to claim 1, wherein the at least one measuring device comprises a plurality of measuring heads or measuring devices.

11. The apparatus according to claim 1, wherein a fabric density is set.

12. The apparatus according to claim 1, wherein for knitted fabrics, a computation takes place in the control and evaluation device on the basis of measured yarn data.

13. The apparatus according to claim 1, further comprising a statistical evaluation device that statistically evaluates measured yarn data.

14. The apparatus according to claim 1, whereby the structure input device alters or creates flat fabric structures.

15. The apparatus according to claim 1, wherein the structure input device and the control and evaluation device comprise a computer.

* * * * *